US006305494B1

(12) United States Patent
Pfaffelhuber et al.

(10) Patent No.: US 6,305,494 B1
(45) Date of Patent: Oct. 23, 2001

(54) DEVICE FOR ABSORBING AND/OR DAMPING SOUND WAVES

(75) Inventors: Klaus Pfaffelhuber, Günzburg; Gerhard Köck, Kienberg; Stefan Lahner; Thomas Ruhe, both of Krumbach, all of (DE)

(73) Assignee: Faist Automotive GmbH & Co. KG, Krumbach (DE)

( * ) Notice: Subject to any disclaimer, the term of this patent is extended or adjusted under 35 U.S.C. 154(b) by 0 days.

(21) Appl. No.: 09/284,559

(22) PCT Filed: Aug. 5, 1997

(86) PCT No.: PCT/EP97/04259

§ 371 Date: Jul. 26, 1999

§ 102(e) Date: Jul. 26, 1999

(87) PCT Pub. No.: WO98/16915

PCT Pub. Date: Apr. 23, 1998

(30) Foreign Application Priority Data

Oct. 14, 1996 (DE) ..... 296 17 845 U

(51) Int. Cl.[7] ..... E04B 1/82
(52) U.S. Cl. ..... 181/286
(58) Field of Search ..... 181/286, 290, 181/291, 293, 294, 295

(56) References Cited

U.S. PATENT DOCUMENTS 4,425,981 * 1/1984 Klesewetter et al. ..... 181/286
5,750,944 * 5/1998 Fuchs ..... 181/286

* cited by examiner

*Primary Examiner*—Khanh Dang
(74) *Attorney, Agent, or Firm*—Hopgood, Calimafde, Judlowe & Mondolino, LLP

(57) ABSTRACT

A device for absorbing and/or damping sound waves has a system for damping and/or silencing sound waves provided with a thin vibratory layer (1) on the side facing the sound waves. In order to improve sound damping and silencing properties, even during a prolonged use with concomitant exposure to strong heat, the thin vibratory layer (1) is made of aluminum or an aluminum alloy and is 0.004 to 0.35 mm thick.

36 Claims, 4 Drawing Sheets

DEVICE FOR ABSORBING AND/OR DAMPING SOUND WAVES

BACKGROUND OF THE INVENTION

The invention relates to a device for absorbing and/or attenuating sound waves with a sound wave absorbing and/or attenuating system using a thin vibratable layer on the side facing the incident sound waves.

Such a device is known in the art (DE-OS 33 13 001). This device is formed by a porous base provided with projecting areas so as to create hollow chambers, which are covered by a foil having a layer thickness of preferably 30 μm, which is placed over the projecting areas. The porous base acts as a sound absorber for the higher frequencies while the foil is a membrane absorber for the lower frequencies.

Other devices with sound wave absorbing and/or attenuating systems are known (EP-0 454 949 A2, DE Utility Model 92 15 132). In these devices, porous nonwovens or open-cell foam, particularly made of polypropylene, are formed so as to create so-called Helmholtz resonators together with a substrate or the engine hood. In one of these embodiments, a polyurethane foil covers the chamber system extending, respectively, along the foam walls forming the chambers.

DE-OS 36 01 204 furthermore discloses a method for forming packing units made of plastic fiber material and highly heat resistant inorganic fiber material, for example basalt fibers, to be used as a sound attenuating lining for the engine compartment of motor vehicles and partly laminating these packing units with a heat reflecting aluminum foil on the side facing the engine.

Finally, it is known in the art (EP-0 439 046 A2, GB Patent 482 747) to arrange aluminum sheets along the exterior of packing units, which are made of corrugated metal layers, to create reflecting heat shields for components that are exposed to flames.

BRIEF STATEMENT OF THE INVENTION

The object of the invention is to improve the devices of the initially cited generic class by simple means so that they can be easily manufactured and can be placed as closely as possible to noise sources and, where appropriate, heat sources while nevertheless providing good long-term sound absorbing and attenuating properties. In addition, the material used for the device should be readily recyclable or disposable without harm to the environment.

The invention is a sound wave absorbing and/or attenuating system comprising a system of resonance chambers for the sound waves, and a thin variable layer of aluminum or aluminum alloy covering the system of resonance chamber, the vibratable layer having a thickness ranging between 0.004 and 0.35 mm on the side facing the incident sound waves. Advantageous embodiments of the invention result from the following description of the figures and the referenced drawings.

According to the invention, the thin vibratable layer is made of aluminum or an aluminum alloy with a layer thickness ranging from 0.004 to 0.35 mm, preferably 0.0045 to 0.020 mm. Experience has shown that despite the use of a significantly more rigid material compared to many plastics, in this case aluminum, such a thin aluminum layer attains the aforementioned object if it is made and arranged so that it can vibrate. "Vibratability" is to be understood as the capability, on impact of the sound waves, of executing oscillations whose amplitude also depends on the degree of the aluminum foil's freedom of oscillation between the parts supporting it. The "thin vibratable foil" transmits airborne sound waves striking it on one side to the air space on the other side even if the "acoustic pressure" is thereby reduced, which is of course also advantageous for acoustic absorption.

The thin vibratable aluminum layer preferably covers a system of resonance chambers according to the so-called Helmholtz principle. For special sound wave frequency spectrums, the aluminum foil may also be at least partially perforated.

In accordance with a preferred embodiment of the invention, the thin vibratable aluminum layer itself is formed into a chamber system by deep drawing. In this as well as in other embodiments of the invention it is recommended to cover the aluminum foil on one side with a thermoplastic layer, for example by lamination. This thermoplastic layer should be made of polypropylene (PP) (polyester, polyethylene or the like are also suitable). The layer thickness should be on the same order as that of the thin aluminum layer. Such an aluminum-thermoplastic composite layer is easily deep-drawn, while nevertheless retaining adequate vibratability on impact of the sound waves.

The aluminum foil can also cover a porous aluminum body, for example a non-woven aluminum fabric. The important thing is that the thin aluminum layer does not lose its ability to vibrate even though this ability is somewhat reduced if non-woven aluminum fabrics are used. This "all aluminum technology" is advantageous with respect to disposal.

The thermoplastic layer is preferably arranged on the side of the aluminum foil facing away from the incident sound waves. The thermoplastic material of this layer can also serve as a coupling agent to a substrate made, in particular, of GMT (glass mat thermoplastics) with which the device is fused together to form a unit.

The inventive vibratable aluminum-thermoplastic composite layer has also proven to be advantageous when it is bonded to the surface of an engine hood facing the engine compartment, e.g., of a motor vehicle. Sound waves produced particularly by the engine frequently cause such engine hoods to vibrate so that the engine hood itself becomes a sound source. By bonding the vibratable aluminum foil via the thermoplastic layer to the engine hood, which is made, in particular, of metal, the vibratable aluminum layer via the thermoplastic layer also becomes an absorbing element for the vibrations of the engine hood. Since the oscillation frequencies of the extremely thin aluminum layer on the one hand and the sheet metal of the engine hood on the other hand differ markedly, the inventive device can also perform its task as sound attenuating and at the same time sound absorbing component.

DETAILED DESCRIPTION

Figure 1:
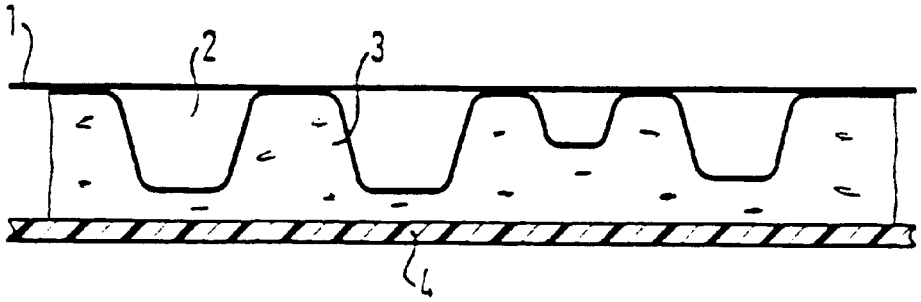
FIG. 1 shows a schematic cross section through an inventive device.

FIG. 1 shows a porous aluminum body 3 made of aluminum fibers, which has trough shaped chambers 2 of different cross sections and different overall depth and is mounted on a substrate 4 made of GMT. An aluminum foil 1 with a layer thickness of 0.01 mm is stretched along the elevations of the porous aluminum body 3 so that it covers chambers 2. Since aluminum foil 1 is vibratable for the respective sound waves, the chambers 2 covered by this foil 1 act as resonance chambers when the foil portions that cover these chambers 2 vibrate. By selecting the size of the resonance chambers and thus also the size of the vibratable portions of aluminum foil 1, sound absorption can extend across a broad frequency spectrum.

Figure 2:
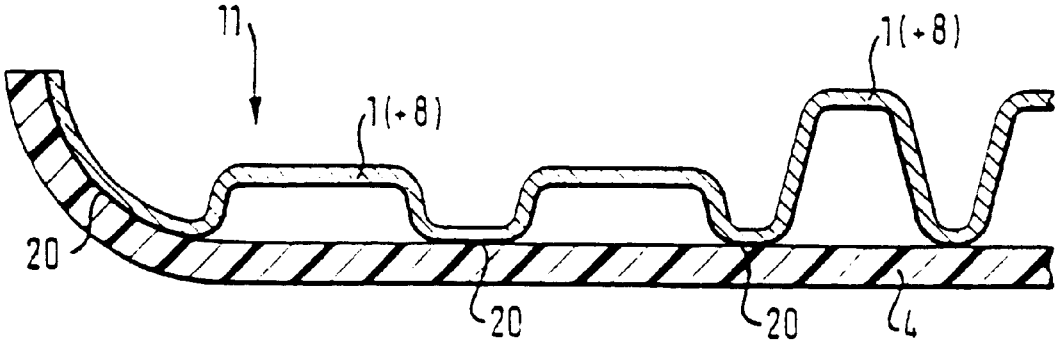
FIG. 2 is a further embodiment with a deep-drawn aluminum-thermoplastic composite foil.

FIG. 2 shows a tube system 11 made by deep-drawing a composite foil that is formed by a vibratable aluminum foil 1 and a thermoplastic foil 8 made of PP and laminated to the back of the aluminum foil. At the lower ends 20 of the deepest chambers 2 a mechanical connection to the GMT material of substrate 4 is produced, for example, by welding. In this example chambers 2 are not covered toward the outside. Here, too, broadband sound wave absorption is created due to the different depth and size of chambers 2.

Figure 3:
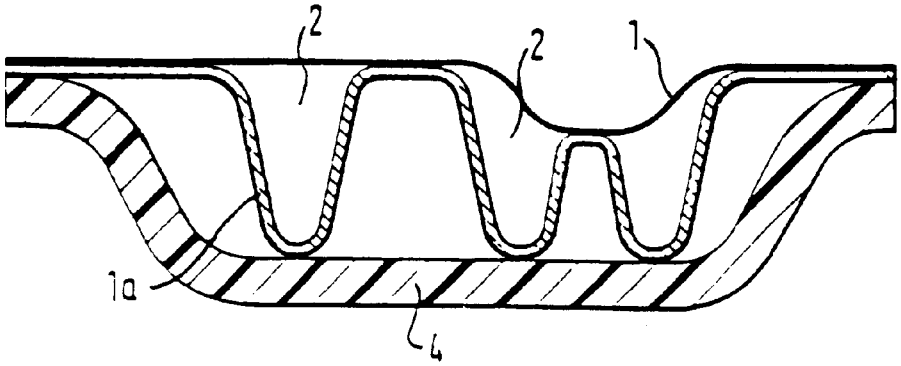
FIG. 3 is a schematic cross section of a further embodiment of the invention with two aluminum foils.

In the exemplary embodiment of FIG. 3, substrate 4 is made as a shell forming, for example, a motor vehicle partition or dashboard. On one side of substrate 4, a chamber system is arranged to absorb the incident sound waves from the engine compartment. An aluminum-thermoplastic composite foil 1 a is deep-drawn in the schematically depicted manner and furthermore covered with an aluminum foil 1, which in turn may be laminated with a thermoplastic foil. This creates a system that produces resonances in chambers 2. The fact that the aluminum-thermoplastic composite foil la is vibratable further improves the broadbandedness.

Figure 4:
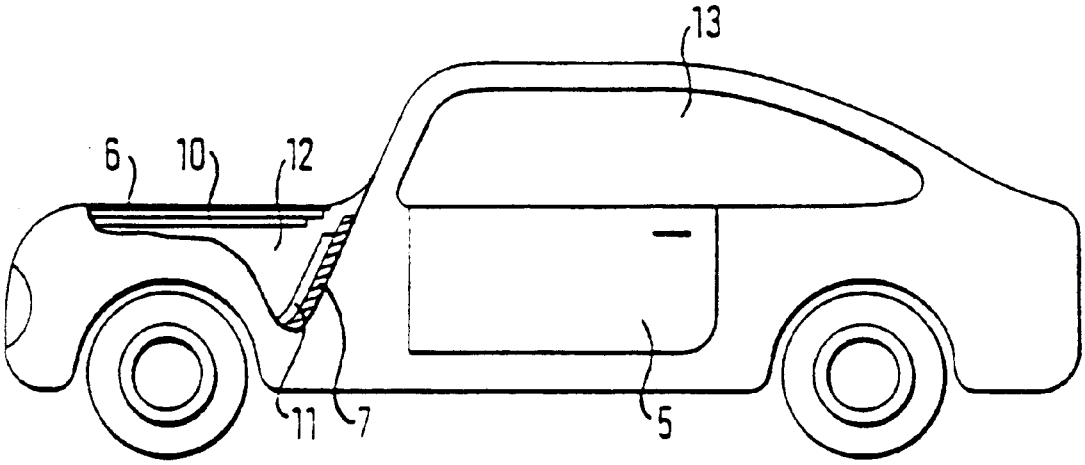
FIG. 4 is a side view of a motor vehicle with partially cut away engine compartment.
Figure 5:
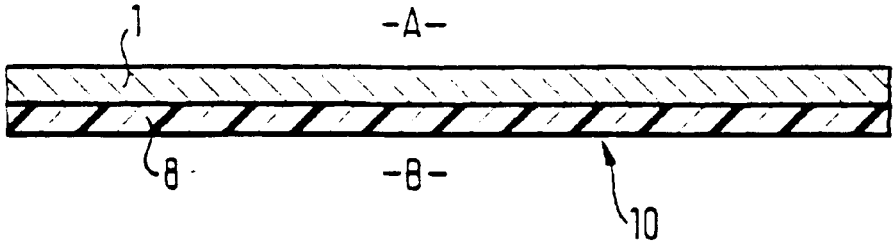
FIG. 5 is an enlarged cross section through an aluminum-thermoplastic composite foil.

In FIG. 4 such a chamber system 11 is arranged on the side facing engine compartment 12 of a partition 7 between engine compartment 12 and vehicle interior 13 of a motor vehicle 5. Furthermore, a composite system 10 comprising an aluminum foil 1 and a laminated foil 8 made of PP according to FIG. 5 is bonded to the underside of engine hood 6. The free side A of aluminum foil 1 is facing engine compartment 12, while the thermoplastic foil 8 on side B provides the connecting layer to the sheet metal of engine hood 6. This creates an oscillatory system comprising aluminum foil 1 on the one hand and the sheet metal of engine hood 6 on the other hand with completely different oscillation frequencies resulting in an absorption of the vibrations of engine hood 6 in the sense of a "sound-deadening." One advantage among others of these inventive sound absorbing and sound-attenuating devices 10 and 11 is that they can be brought very close to the engine units, which simultaneously serve as a source of heat. This results in considerable space savings without impairing the performance of the inventive sound-absorbing and sound-attenuating devices even if the heat development is significant.

Figure 6:
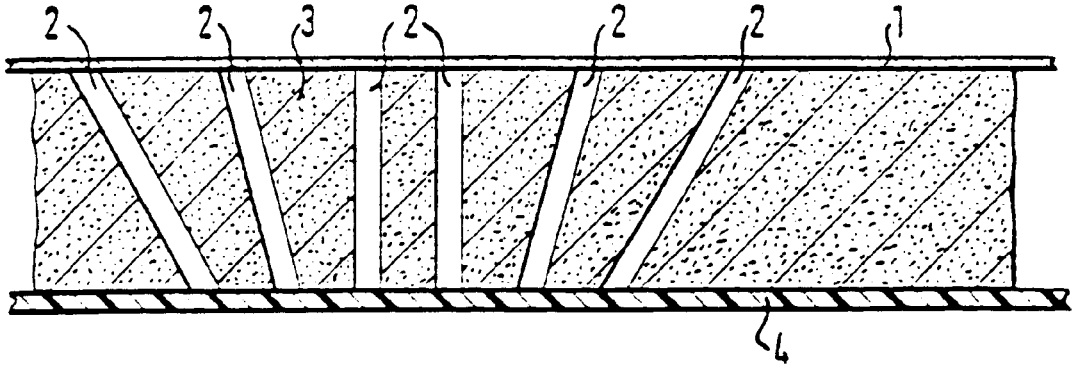
FIG. 6 is a cross sectional side elevation view of a further embodiment of the invention with partially cut away aluminum foil.
Figure 7:
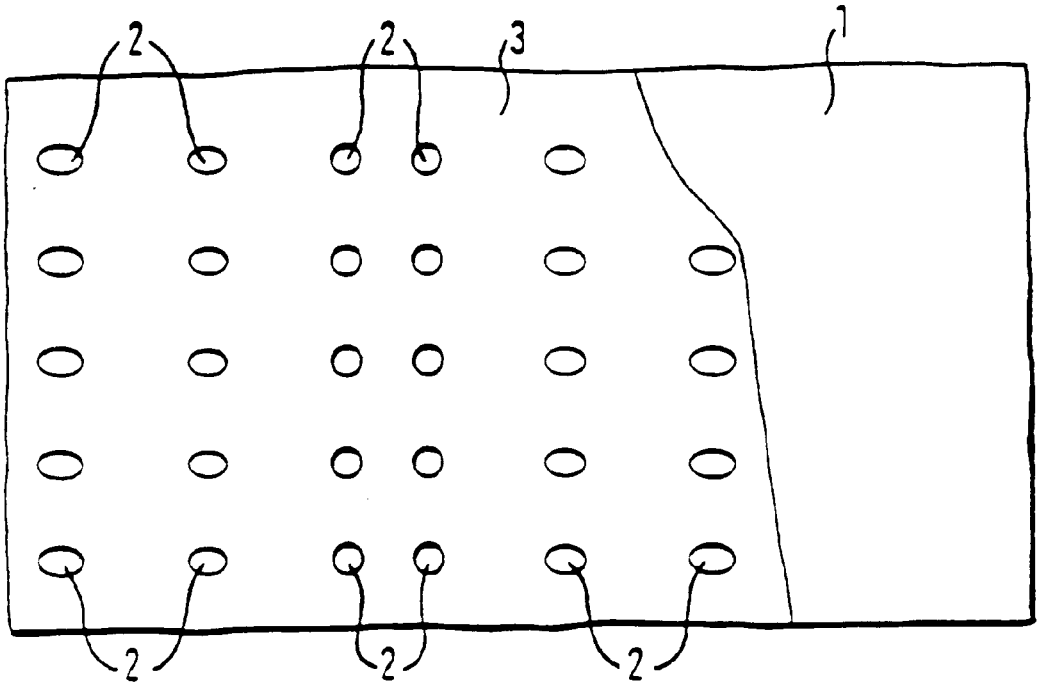
FIG. 7 is a top plan view of the further embodiment of FIG. 6.

According to FIGS. 6 and 7, the porous body 3, which is made, in particular, from non-woven aluminum fabric or another readily recyclable or disposable material is provided with tubular chambers 2, which are aligned at different angles relative to substrate 4 and also to the covering aluminum foil 1, which is vibratable.

Figure 8:
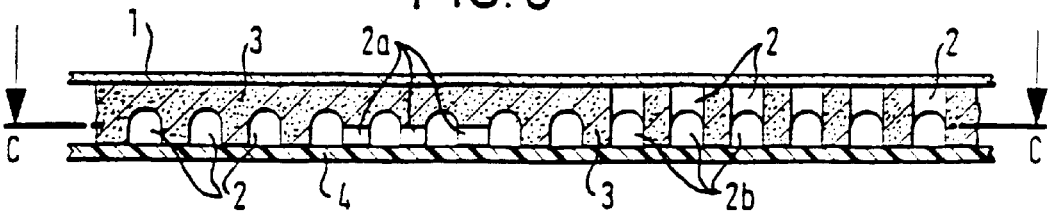
FIG. 8 is a further embodiment of the invention with a system of resonance chambers interconnected by channels.
Figure 9:
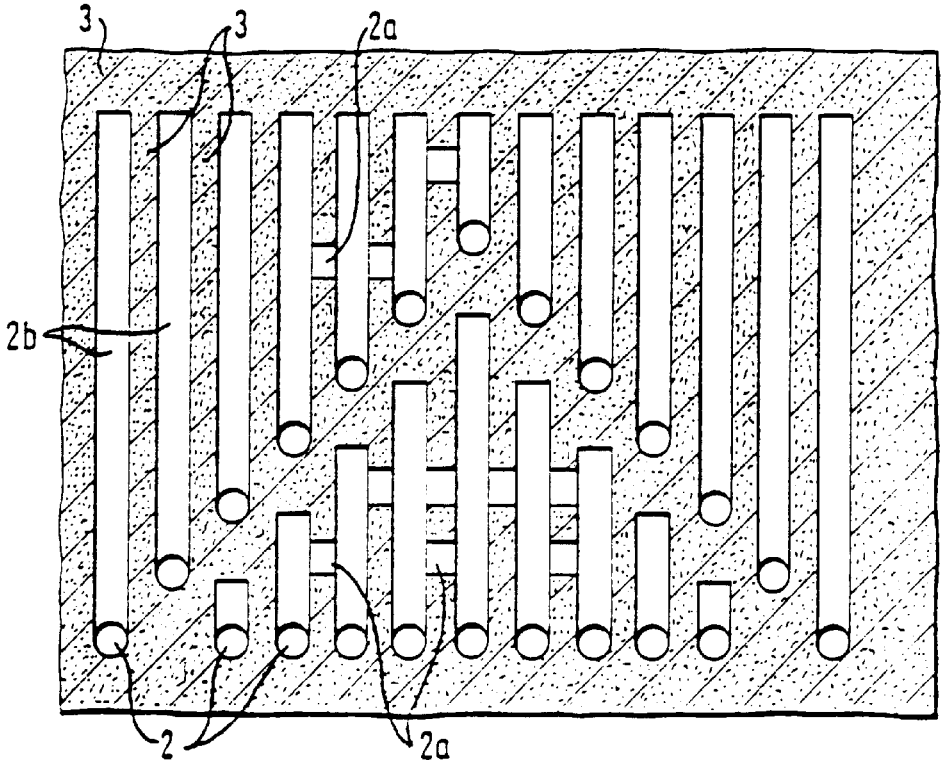
FIG. 9 is a top plan sectional view of the further embodiment of FIG. 8 in the plane indicated by line C—C of FIG. 8.
Figure 10:
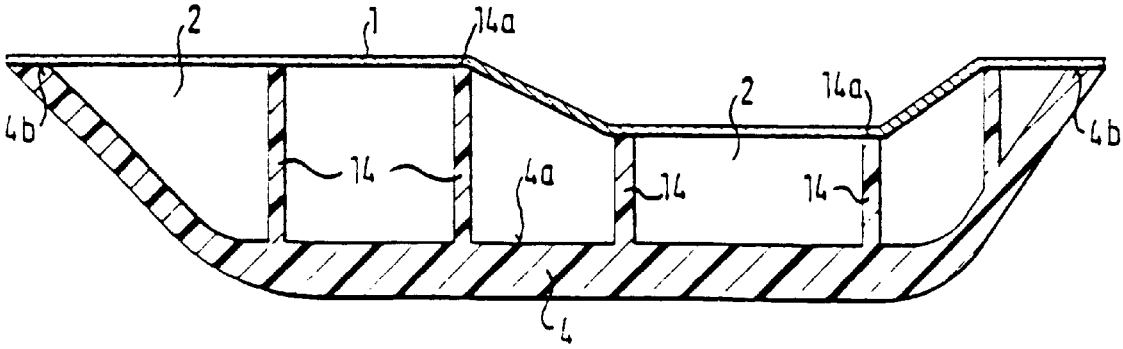
FIG. 10 is a cross-section of a further preferred embodiment.

According to FIGS. 8 and 9, the vibratable aluminum foil I covers the porous body 3 towards the top in such a way that the thin aluminum foil 1 in any case remains vibratable in a certain sense so that the air space in chambers 2 is caused to oscillate. From there air oscillations propagate through the transversely extending channels 2a and 2b having different lengths with the advantage that this chamber system can absorb a very broad frequency spectrum of sound waves. According to FIG. 10, substrate 4 is a dish shaped substrate shell. It is made, for example, of GMT and is prefabricated by a deep-drawing process. From the interior 4*a* of the substrate shell, plate shaped spacers 14 extend substantially perpendicularly to the plane of the substrate shell up to the point where they serve to support the thin vibratable aluminum layer 1 with a layer thickness of 0.1 mm, which is stretched across them. On its interior side facing substrate 4, the foil is coated with a thermoplastic layer made of polypropylene and (thermally) fused with or glued to the edges 4*b* of the shell shaped substrate 4 as well as the free ends 14*a* of the strip shaped spacers 12. The membrane-like layer 1 is tightly stretched. Resonance chambers 4 are formed between the substrate shell and layer 1. Spacers 14 are made of the same material as the substrate shell and are preferably produced together with the shell as a single part, e.g., by a transfer molding process.

What is claimed is:

1. A sound wave absorbing and/or attenuating system comprising:

a system of resonance chambers (2) for the sound waves; and a thin vibratable layer (1) of aluminum or an aluminum alloy covering the system of resonance chambers (2), the vibratable layer (1) having a thickness ranging between 0.004 and 0.35 mm on the side facing the incident sound waves.

2. A sound wave absorbing and/or attenuating system according to claim 1, wherein the system of resonance chambers constitutes a deep-drawn chamber system (11).

3. A sound wave absorbing and/or attenuating system according to claim 2, wherein the thin aluminum layer (1) is formed into the deep-drawn chamber system (11).

4. A sound wave absorbing and/or attenuating system according to claim 1, wherein on the side facing away from the incident sound waves, the vibratable aluminum layer (1) is covered with a thin layer (8) of thermoplastic material.

5. A sound wave absorbing and/or attenuating system according to claim 4, wherein the thickness of the thermoplastic layer (8) is of the same order of magnitude as the thickness of the aluminum layer (1).

6. A sound wave absorbing and/or attenuating system according to claim 4, wherein polypropylene is used for the thin layer (8) of thermoplastic material.

7. A sound wave absorbing and/or attenuating system according to claim 1, wherein the thin vibratable aluminum layer (foil) has a layer thickness between 0.0045 and 0.020 mm.

8. A sound wave absorbing and/or attenuating system according to claim 1, wherein the thin aluminum layer (1) covers a porous aluminum body (3).

9. A sound wave absorbing and/or attenuating system according to claim 8, wherein aluminum fibers serve as a fleece of the porous aluminum body (3).

10. A sound wave absorbing and/or attenuating system according to claim 4, wherein the thermoplastic layer (8) is fused with a substrate carrier (4).

11. A sound wave absorbing and/or attenuating system according to claim 10, wherein the carrier (4) is of GMT.

12. A sound wave absorbing and/or attenuating system according to claim 1, wherein the thin aluminum layer (1) is fastened to the inner surface of the hood (6) of an automotive vehicle (5).

13. A sound wave absorbing and/or attenuating system according to claim 12, wherein the thin aluminum layer (1) is fastened to the forward side of a dividing wall (7) between the engine compartment (12) and the passenger's (driver's) space (13) of an automotive vehicle (5).

14. A sound wave absorbing and/or attenuating system according to claim 4, wherein the bond of the thin aluminum layer (1) with the covering thermoplastic layer (8) is in the form of a membrane which spans a one-piece unit formed by a shell-like substrate carrier (4) and by spacers (14) extending from said carrier and formed of the same material as said carrier, said thermoplastic layer (8) being united to free ends (14*a*) of said unit so that said resonance chambers (2) are defined between the aluminum layer (1) and the carrier (4), said resonance chambers (2) being air-filled.

15. A sound wave absorbing and/or attenuating system comprising a resonance chamber (2) for the sound waves having at least one surface defined by a thin vibratable layer (1) of aluminum or an aluminum alloy having a thickness ranging between 0.004 and 0.35 mm on the side facing the incident sound waves.

16. A sound wave absorbing and/or attenuating system according to claim 15 and further comprising an intermediate vibratable layer (1*a*) and a carrier (4), said intermediate vibratable layer (1*a*) being disposed between said vibratable layer (1) and carrier (4) such that portions of said vibratable layer (1) and carrier (4) are bridged by said intermediate vibratable layer (1*a*), said intermediate layer having an expanded pleated configuration to define a plurality of resonance chambers (2) between said vibratable layer (1) and carrier (4), one of said resonance chambers constituting said resonance chamber (2).

17. A sound wave absorbing and/or attenuating system according to claim 16 wherein said carrier comprises an internal surface of an automotive vehicle (5).

18. A sound wave absorbing and/or attenuating system according to claim 15 wherein said chamber (2) is tubular and has a longitudinal axis inclined relative to said vibratable layer (1) to define a first angle.

19. A sound wave absorbing and/or attenuating system according to claim 18 and further comprising a second resonance chamber (2) having at least one side defined by said vibratable layer (1), said second resonance chamber (2) being tubular and having a longitudinal axis inclined relative to said vibratable layer (1) to define a second angle, said second angle differing from said first angle.

20. A sound wave absorbing and/or attenuating system according to claim 15 wherein said resonance chamber (2) comprises an elongate first portion one end of which is contiguous with said vibratable layer (1), said resonance chamber (2) comprising an elongate second portion (2*b*) one end of which is contiguous with the other end of said first portion, said second portion (2*b*) having a longitudinal axis generally parallel to said vibratable layer (1).

21. A sound wave absorbing and/or attenuating system according to claim 15 wherein said resonance chamber (2) defines a first resonance chamber, said system further comprising:

a second resonance chamber (2) having at least one side defined by said vibratable layer (1), said second resonance chamber (2) comprising an elongate first portion one end of which is contiguous with said vibratable layer (1), said second resonance chamber (2) comprising an elongate second portion (2*b*) one end of which is contiguous with the other end of said first portion of said second resonance chamber (2), said second portion (2*b*) of said second resonance chamber (2) having a longitudinal axis generally parallel to said vibratable layer (1), said second portions (2*b*) of said first and second resonance chambers (2) having respective lengths which differ from one another.

22. A sound wave absorbing and/or attenuating system according to claim 15 wherein said resonance chamber (2) defines a first resonance chamber, said system further comprising:

a second resonance chamber (2) having at least one side defined by said vibratable layer (1), said second resonance chamber (2) comprising an elongate first portion one end of which is contiguous with said vibratable layer (1), said second resonance chamber (2) comprising an elongate second portion (2*b*) one end of which is contiguous with the other end of said first portion of said second resonance chamber (2), said second portion (2*b*) of said second resonance chamber (2) having a longitudinal axis generally parallel to said vibratable layer (1); and a channel (2*a*) connected to said second portions (2*b*) of said first and second resonance chambers (2) to provide a passage between said second portions (2*b*).

23. A device for absorbing and/or attenuating sound waves with a sound wave absorbing and/or attenuating system using a thin vibratable layer on the side facing the incident sound waves, wherein the thin vibratable aluminum layer (1) is made of aluminum or an aluminum alloy and has a layer thickness ranging from 0.004 to 0.35 mm.

24. The device according to claim 23, wherein the thin vibratable layer (1) is an aluminum foil with a layer thickness ranging from 0.0045 to 0.020 mm.

25. The device according to claim 23, wherein the thin aluminum layer (1) is perforated.

26. The device according to claim 23, wherein the thin aluminum layer (1) on side (B) facing away from the incident sound waves (A) is coated with a thin thermoplastic layer (8).

27. The device according to claim 26, wherein polypropylene is used for the thin thermoplastic layer (8).

28. The device according to claim 23, wherein the thin aluminum layer (1) is formed into a deep-drawn chamber system (11) and/or covers such a chamber system.

29. The device according to claim 28, wherein chambers (2) of the chamber system form resonance chambers for sound waves.

30. The device according to claim 23, wherein the thin aluminum layer (1) covers a porous aluminum body (3).

31. The device according to claim 30, wherein non-woven aluminum fabric serves as the porous aluminum body (3).

32. The device according to claim 26, wherein the thermoplastic layer (8) is fused with a substrate (4).

33. The device according to claim 32, wherein substrate (8) is made of GMT.

34. The device according to claim 23, wherein the thin aluminum layer (1) is bonded to the interior surface of an engine hood (6) of a motor vehicle (5).

35. The device according to claim 34, wherein the thin aluminum layer (1) is attached to side (8) facing toward engine compartment (12) of a partition (7) between engine compartment (12) and passenger compartment (13) of a motor vehicle (5).

36. The device according to claim 26, wherein the composite of the thin aluminum layer (1) and the laminated thermoplastic layer (8) is stretched like a membrane across a component and bonded with the edges thereof **(4*b*), which component is formed by a shell-type substrate (4) and spacers (14), which are integral therewith and are made of the same material, particularly GMT, and are projecting from substrate (4) in the form of strips such that air-filled chambers are created between the aluminum layer (1) and the substrate (4) with spacers (14)**.

* * * * *